US005252772A

United States Patent [19]

Wright

[11] Patent Number: 5,252,772

[45] Date of Patent: Oct. 12, 1993

[54] PIANO TEACHING COMPUTER SYSTEM

[76] Inventor: Martin J. Wright, 184 Ninth Ave., #3A, New York, N.Y. 10011

[21] Appl. No.: 801,401

[22] Filed: Dec. 2, 1991

[51] Int. Cl.[5] ..... G10F 1/02

[52] U.S. Cl. ..... 84/18; 84/20; 84/462; 84/470 R; 84/478; 84/601

[58] Field of Search ..... 84/17, 18, 19, 20, 462, 84/470 R, 477 R, 478, 601

[56] References Cited

U.S. PATENT DOCUMENTS 3,724,097 4/1973 Schmoyer ..... 84/477 R X
4,843,936 7/1989 Murakami et al. ..... 84/20 X
4,873,905 10/1989 Murakami et al. ..... 84/20
4,913,026 4/1990 Kaneko et al. ..... 84/462 X
5,131,306 7/1992 Yamamoto ..... 84/19

*Primary Examiner*—Michael L. Gellner
*Assistant Examiner*—Patrick Stanzione
*Attorney, Agent, or Firm*—Richard L. Miller

[57] ABSTRACT

A computer system connected through appropriate analog and digital circuitry controls or monitors a piano. Solenoids connected to each piano key and to each note-sounding hammer permit a computer program to control the keys and/or the sounding of a note, as well as transmitting to the computer for storage and analysis information concerning a student's performance.

16 Claims, 2 Drawing Sheets

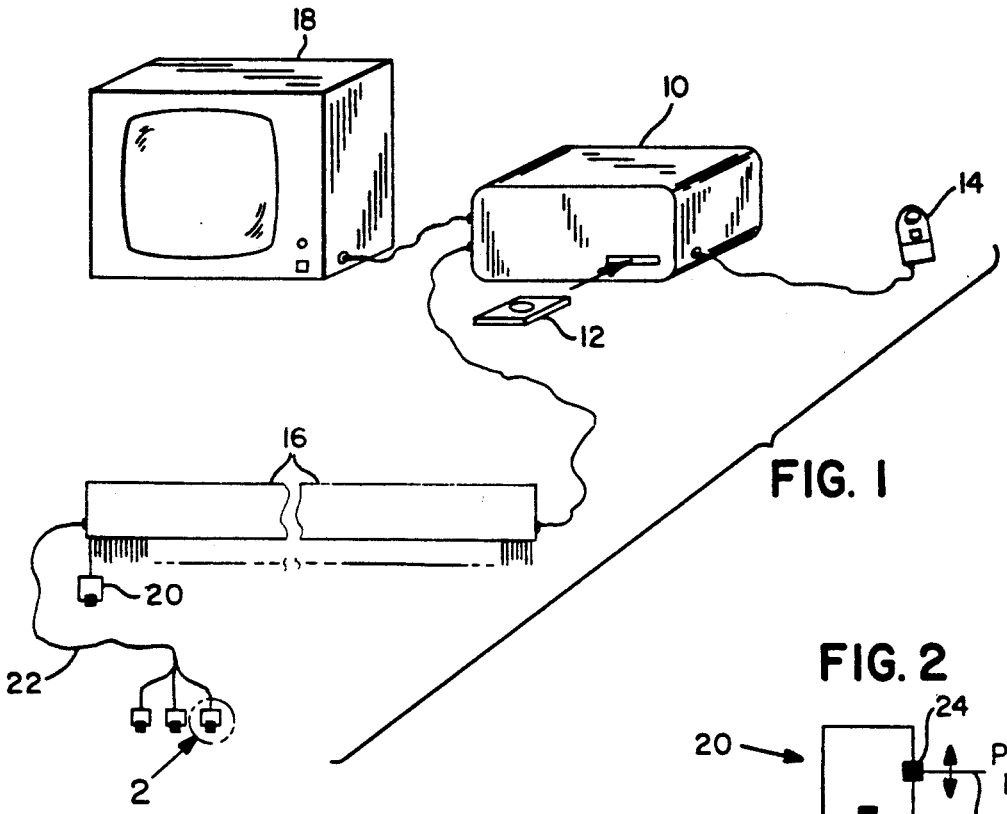
FIG. 1
FIG. 2
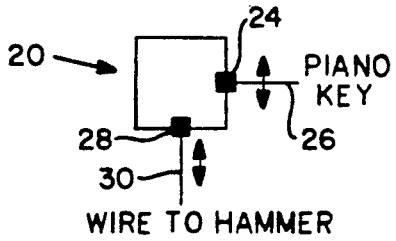
FIG. 3
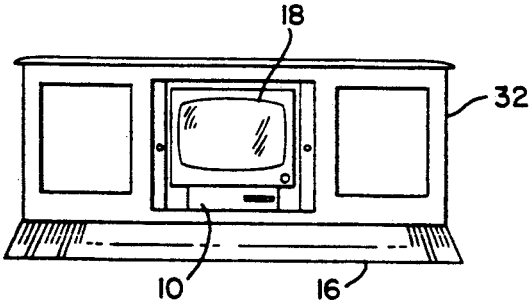
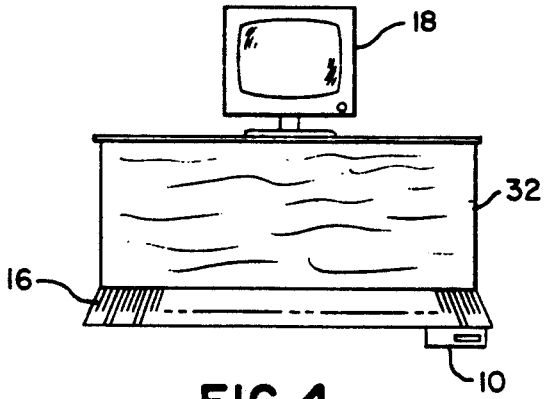
FIG. 4

PIANO TEACHING COMPUTER SYSTEM

BACKGROUND OF THE INVENTION

1. Field of the Invention

This invention relates to a computer system connected through analog and digital interfaces to control or record information from piano keys and/or note-producing hammers in a piano. The system assists a student in learning to play a piano.

2. Description of the Prior Art

There are a multitude of methods and techniques for teaching students to play a piano or other keyboard instrument. Each instructor has a preferred style or theory, but almost all agree that practice is the major element in learning to play. Practice alone, however, is of little or no benefit without critical feedback from the instructor, since practicing incorrect techniques only reinforces such errors.

It is not only impractical but very expensive to have a professional instructor at every practice session. As a result there are a large number of devices on the market which claim to make learning to play a piano a painless and simple experience. Some of the devices are relatively simple and do in fact provide some assistance to beginners, such as lettering or numbering keys. For example, U.S. Pat. No. 3,731,582 to Gullickson describes a system for lighting the keys to be played, and electronically responds to the tone of musical compositions to light up the appropriate piano keys and assist a pianist in accompanying a musical composition.

Another electronic musical learning aid uses a microprocessor to assist a learner to respond to and mimic a tune or a sequence of tones. This system is described in U.S. Pat. No. 4,441,399 to Wiggins et al.

An electronic system in which lights on an instructor's console are turned on in response to the piano keys played by a student is shown in U.S. Pat. No. 3,470,785 to Schallenberger et al.

The present invention utilizes a suitably programmed digital computer to assist a student in learning to play a piano. In one mode the computer is connected through a control system to physically move the selected keys on the piano and/or to sound the desired note(s). This will assist the student in pointing out the proper keys to play and the required timing, or in playing a duet with the student. In another mode the control system will record the notes played by a student, as well as the timing and other indicia of technique, in order to store or analyze the performance and assist in correcting errors. With appropriate connections within the piano key actuating devices, the system of this invention can also connect or disconnect the piano key from the hammer, or prevent selected keys from being played.

SUMMARY OF THE INVENTION

It is therefore an object of this invention to provide a piano teaching system in which a digital computer is connected through a controller assembly to move the piano keys and/or to sound notes in response to a computer program.

Another object of this invention is a piano teacher in which a video screen is connected with a digital computer which responds to piano key movement to provide a student with information about the piano playing performance.

A further object of this invention is a digital control system for a piano which will record and analyze a student's performance.

A still further object of this invention is a digital control system which will actuate a piano to play a duet with a student.

A further object is to provide piano teaching computed system that is simple and easy to use.

A still further object is to provide piano teaching computed system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the piano teaching computer control system components;

FIG. 2 is an enlarged diagrammatic view of the apparatus shown at arrow 2 of FIG. 1;

FIGS. 3 and 4 illustrate typical views of a piano which incorporates the apparatus of this invention;

DESCRIPTION OF THE PREFERRED EMBODIMENT

Figure 5:
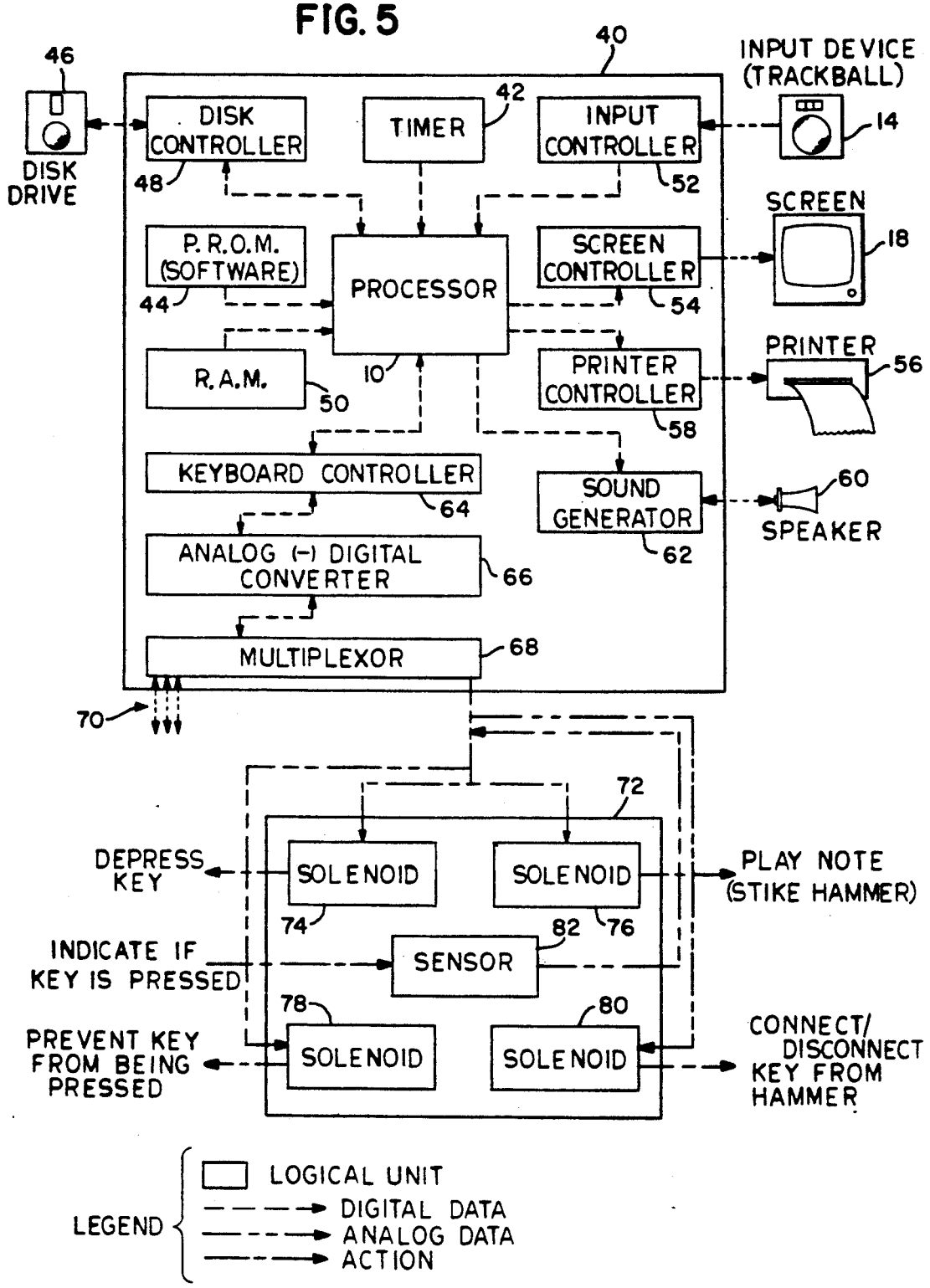
FIG. 5 is a schematic drawing in block diagram form of the system components of this invention.

This invention, in one mode, uses the speed and storage capacity of a digital computer connected through appropriate conditioning circuitry, through an analog-to-digital converter and through servomechanism devices such as a solenoid or fast-acting motor to physically move the piano keys and/or sound the notes of the piano by moving the hammer to strike the sounding wires. The timing of the movement of the keys or the hammer can be varied by the computer program to adjust to the particular music or the skill of the student. With the addition of more sophisticated control devices, the force and manner of key movement and/or hammer movement can be varied, as well as the piano damping, to duplicate any musical composition. In some cases it may be desirable to prevent movement of certain piano keys as a teaching tool.

In a second mode the computer will record and store a musical performance, and, if desired, compare the performance with the musical score to analyze the performance and provide corrective suggestions and analysis to the student. In this mode transducers are required to indicate the key or note being played, and with more complex systems the key force, rate of movement and other characteristics of the performance including damping. In its simplest mode of operation the solenoid which is used to move the keys and/or hammer is used as the input transducer. The transducer responds to movement of the key and/or hammer and produces an analog signal indicative thereof which is then fed through conditioning circuitry and an analog-to-digital converter so that information relating to the performance is stored in the computer memory for display or analysis as directed by the software. Alternatively a separate input transducer may be used and produce an analog or digital output signal.

Referring to the drawings, FIG. 1 shows a microprocessor 10 which is provided with program instructions from disk drive 12 with additional control input from mouse/trackball 14. The microprocessor 10 is connected to a modified piano keyboard 16. A monitor 18 displays information as directed by the system program via the microprocessor 10. A plurality of control mechanisms, one of which is shown schematically at 20, comprise a first actuator connected to each key of the piano, and a second actuator connected to the hammer which sounds the note by striking a wire strung in the piano in response to movement of the key. Control mechanisms comprising a single actuator may also be connected to the piano damping pedals. A plurality of such control mechanisms are shown connected to conductor 22, one of the control mechanisms being enclosed in a circle labeled with reference numeral 2, indicating that the control mechanism is shown in more detail in FIG. 2.

Referring to FIG. 2, the control mechanism 20 consists of an actuator 24 such as a solenoid or a fast-acting motor connected to the mechanism which produces movement of a piano key via line 26, and a second actuator 28 connected via line 30 to the mechanism which moves the hammer which will sound the note to which the piano key is connected. Actuators 24 and 28 are controlled by analog electrical control signals fed from microprocessor 10 through the appropriate electrical conditioning circuitry and drivers. The actuators 24 and 28 are connected preferably in the mechanical linkage between the piano key and the hammer such that each may be moved independently. For pianos of small size, or if independent movement is not desired, it is within the scope of this invention to provide a single actuator which moves both the piano key and the hammer simultaneously, recognizing that some features of this invention will be lost thereby.

In its preferred construction the actuators 24 and 28 will not interfere with the normal playing of the piano, and the control system of this invention will only be operable when separately enabled, such as by a switch located on the keyboard.

In a further embodiment of this invention, movement of the piano key by a student may be sensed by a transducer, and a signal indicative of such movement transmitted through appropriate conditioning circuitry including an analog-to-digital converter to the microprocessor 10 where it is stored. If the actuator for the piano key takes the form of a solenoid having a metal core connected with the mechanism which moves the piano key, appropriate circuitry connected with the solenoid will sense movement of the metal core in response to key movement and produce a signal indicative thereof so that the solenoid can be used as both an actuator and an input transducer. Depending on the degree of sophistication desired, the actuator/input transducer can also sense rate of key movement and force such that the computer will receive data indicative of a large number of elements of the piano performance by the student. The data may thereby be stored and/or analyzed as desired and displayed to the student or instructor. For example, by comparing the notes played, the timing, and the force and rate of movement of the key with the music as written, a suitable program can analyze the student's performance and provide useful information for improvement of the performance. A benefit of the use of this system is that the computer system is uniformly patient with the student, and can be programmed to create a positive learning environment.

FIG. 3 shows a consul version of the invention in which the microprocessor 10 and monitor 18 are built into the piano console 32 to which is attached the keyboard 16. Doors may be closed to conceal the monitor 18 when not in use. In FIG. 4 the monitor 18 is on top of the piano console 32, with the microprocessor 10 having a disk drive being located under keyboard 16.

FIG. 5 shows a block diagram of the preferred control system. Hardware is readily available for the functions shown. Block 40 contains the computing functions and related electronic and logic functions. The microprocessor 10 is the heart of the system, programmed in accordance with instructions contained in programmable read only memory 44, or produced by disk drive 46 connected to microprocessor 10 through disk controller 48. Data from microprocessor 10 may also be fed to the disk drive 46 via disk controller 48. Data storage for the microprocessor 42 is provided in random access memory 50. An auxiliary input for microprocessor 10 is trackball 14 connected through input controller 52. A timer 42 is also connected to the microprocessor 10.

Output devices fed and controlled by microprocessor 10 are monitor/screen 18 with its screen controller 54, printer 56 with its printer controller 58, and speaker 60 with its sound generating circuitry 62.

A keyboard controller block shown at 64 represents the circuitry necessary to process digital signals from the microprocessor 10 and feed them to a digital-to-analog converter 66 and then through a multiplexor 68 which produces a plurality of output signals 70 which in turn are fed to the control mechanism and actuators controlling the movement of the piano keys and the hammers as previously described.

The control mechanisms/actuators for a selected piano key/note are contained within block 72. The actuators comprise solenoid 74 which, when selected, will depress the key; solenoid 76 which, when selected, will move the hammer to sound the note; solenoid 78 which, when selected, will prevent the key from being depressed; and solenoid 80 which, when selected, will connect/disconnect the key from the hammer. The function of solenoid 80 may be combined with that of solenoid 74. appropriate electromechanical devices are known in the art to accomplish each function, and need not be described in detail.

In the recording mode, sensor 82 is the input transducer or solenoid which produces an analog signal upon movement of the key. This signal is fed through multiplexor 68 to the analog-to-digital converter 66 and keyboard controller 64 to the microprocessor 10 for storage and analysis as described previously.

The piano teacher control system of this invention may be used to perform one or more of the following: to indicate when mistakes are made when a musical composition is played; to suggest that a passage be repeated or played differently to correct mistakes; to play one hand of a composition while the student plays the other; to play a duet with a student; to display a musical composition as written or in a simplified format on the monitor screen; to indicate pictorially the notes to play; to suggest fingering of a chord or passage; to prevent the playing of certain notes; to simplify a musical composition for beginning students; to analyze components of a student's performance; to act as a player piano; and to display and/or print and/or sound the composition played by the student.

While the invention has been described with respect to its preferred embodiment, it is apparent that changes may be made to the details of construction and its functions without departing from the scope of the invention as hereinafter claimed.

What is claimed is:

1. A control system for a keyboard piano having manually operable mechanical means for sounding a plurality of discrete notes simultaneously or in sequence including a movable key for each note and hammer means connected with and responsive to movement of each key for sounding the note, said control system being adapted to assist a student, comprising:

a) a first means for storing in digital format data indicative of a plurality of notes to be played by said piano;

b) a microprocessor connected with said first means for receiving said data and producing a plurality of digital control signals indicative of said plurality of notes;

c) controller means including a digital-to-analog converter and a multiplexer receiving said digital signals and producing therefrom a plurality of analog signals representing the notes to be played;

d) a plurality of actuator means, one of which is connected with the mechanical means for sounding each note of said piano and adapted to affect a condition of operation of said mechanical means when actuated;

e) means for connecting individual ones of said plurality of analog signals to the appropriate actuator means for producing actuation of said actuator means to produce said plurality of notes; and f) means connected with each said actuator means for causing said key to be selectively connected and disconnected from its associated hammer.

2. A control system as in claim 1 in which said actuator means comprises a solenoid connected with each said hammer means wherein said actuator means causes said hammer means to sound the selected note.

3. A control system as in claim 1 in which said actuator means comprises a solenoid connected with each said key wherein said actuator means causes said key to be depressed.

4. A control system as in claim 1 in which said actuator means comprises a solenoid connected with each said key wherein said actuator means prevents said key from being depressed.

5. A control system as in claim 1 and further including:

a) transducer means connected with each said key for producing an analog input signal indicative of manual movement of said key;

b) circuit means receiving said input signal and converting said input signal into a digital signal indicative thereof; and c) data storage means connected with said microprocessor for receiving said digital signal and storing therein data representative of said key movement.

6. A control system as in claim 2 in which said transducer is a solenoid connected with each said piano key, said solenoid also being adapted to produce movement of said piano key.

7. A control system as in claim 5 and further including display means connected with said microprocessor for displaying data indicative of manual key movement.

8. A control system as in claim 1 in which said piano includes damping pedals, and said control system further includes:

a) pedal actuator means connected with each said pedal; and b) signal means for actuating said pedal actuator means in conjunction with the sounding of said notes.

9. A control system for a keyboard piano having manually operable mechanical means for sounding a plurality of discrete notes simultaneously or in sequence including a movable key for each note and hammer means connected with and responsive to movement of each key for sounding the note, said control system being adapted to assist a student, comprising:

a) a first means for storing in digital format data indicative of a plurality of notes to be played by said piano;

b) a microprocessor connected with said first means for receiving said data and producing a plurality of digital control signals indicative of said plurality of notes;

c) controller means including a digital-to-analog converter and a multiplexer receiving said digital signals and producing therefrom a plurality of analog signals representing the notes to be played;

d) a plurality of actuator means, one of which is connected with the mechanical means for sounding each note of said piano and adapted to affect a condition of operation of said mechanical means when actuated;

e) means for connecting individual ones of said plurality of analog signals to the appropriate actuator means for producing actuation of said actuator means to produce said plurality of notes; and f) means connected with each said actuator means for causing movement of said key independently of movement of its associated hammer.

10. A control system as in claim 9 in which said actuator means comprises a solenoid connected with each said hammer means wherein said actuator means cause said hammer means to sound the selected note.

11. A control system as in claim 9 in which said actuator means comprises a solenoid connected with each said key wherein said actuator means causes said key to be depressed.

12. A control system as in claim 9 in which said actuator means comprises means connected with each said key wherein said actuator means prevents said key from being depressed.

13. A control system as in claim 9 and further including:

a) transducer means connected with each said key for producing an analog input signal indicative of manual movement of said key;

b) circuit means receiving said input signal and converging said input signal into a digital signal indicative thereof; and c) data storage means connected with said microprocessor for receiving said digital signal and storing therein data representative of said key movement.

14. A control system as in claim 13 in which said transducer is a solenoid connected with each said piano key, said solenoid also being adapted to produce movement of said piano key.

15. A control system as in claim 13 and further including display means connected with said microprocessor for displaying data indicative of manual key movement.

16. A control system as in claim 9 in which said piano includes damping pedals, and said control system further include:

a) pedal actuator means connected with each said pedal; and b) signal means for actuating said pedal actuator means in conjunction with the sounding of said notes.

* * * * *